US008057586B2

(12) United States Patent
Powers et al.

(10) Patent No.: US 8,057,586 B2
(45) **Date of Patent: *Nov. 15, 2011**

(54) HUMIDITY CONTROL FOR PRODUCT IN A REFRIGERATOR

(75) Inventors: Thomas H. Powers, Mayville, NY (US); John Crump, Buffalo, NY (US); George E. McKedy, Williamsville, NY (US)

(73) Assignee: Multisorb Technologies, Inc., Buffalo, NY (US)

( * ) Notice: Subject to any disclaimer, the term of this patent is extended or adjusted under 35 U.S.C. 154(b) by 678 days.

This patent is subject to a terminal disclaimer.

(21) Appl. No.: 12/180,983

(22) Filed: Jul. 28, 2008

(65) Prior Publication Data

US 2010/0018236 A1 Jan. 28, 2010

(51) Int. Cl.
*B01J 20/02* (2006.01)
*F25D 21/04* (2006.01)

(52) U.S. Cl. ..... 96/118; 96/153; 252/194; 252/188.28

(58) Field of Classification Search ..... 96/108, 96/118, 119, 147, 153, 154; 95/91, 138, 95/144; 252/194, 188.28; 206/204; 502/405, 502/417

See application file for complete search history.

(56) References Cited

U.S. PATENT DOCUMENTS

| | | | | |
|---|---|---|---|---|
| 2,752,221 | A | | 6/1956 | Wachter et al. |
| 3,492,258 | A | | 1/1970 | Kremer |
| 3,549,549 | A | | 12/1970 | Henderson |
| 3,833,406 | A | | 9/1974 | White |
| 4,036,360 | A | | 7/1977 | Deffeyes |
| 4,061,807 | A | | 12/1977 | Shaler et al. |
| 4,366,179 | A | | 12/1982 | Nawata et al. |
| 4,407,897 | A | | 10/1983 | Farrell et al. |
| 4,552,767 | A | | 11/1985 | Saleeb et al. |
| 4,559,321 | A | | 12/1985 | Slaugh |
| 4,730,726 | A | | 3/1988 | Holzwarth |
| 4,769,175 | A | | 9/1988 | Inoue |
| 4,792,484 | A | | 12/1988 | Moritani |
| 4,837,020 | A | | 6/1989 | Mise et al. |
| 4,856,650 | A | | 8/1989 | Inoue |
| 4,894,277 | A | | 1/1990 | Akasaki |
| 4,935,346 | A | | 6/1990 | Phillips et al. |
| 4,970,172 | A | | 11/1990 | Kundu |
| 5,002,792 | A | | 3/1991 | Vegoe |
| 5,049,487 | A | | 9/1991 | Phillips et al. |
| 5,078,909 | A | | 1/1992 | Shigeta et al. |
| 5,108,706 | A | | 4/1992 | Saggiorato |
| 5,147,698 | A | | 9/1992 | Cole |
| 5,207,943 | A | | 5/1993 | Cullen et al. |
| 5,238,652 | A | | 8/1993 | Sun et al. |
| 5,262,375 | A | | 11/1993 | McKedy et al. |
| 5,286,407 | A | | 2/1994 | Inoue et al. |
| 5,304,419 | A | | 4/1994 | Shores |
| 5,304,468 | A | | 4/1994 | Phillips et al. |
| 5,403,548 | A | * | 4/1995 | Aibe et al. ..... 422/5 |
| 5,432,214 | A | | 7/1995 | Lancesseur |
| 5,435,958 | A | | 7/1995 | Dinnage et al. |
| 5,451,248 | A | * | 9/1995 | Sadkowski et al. ..... 95/99 |
| 5,460,777 | A | | 10/1995 | Kitajima et al. |
| 5,500,470 | A | | 3/1996 | Mirle et al. |
| 5,503,662 | A | | 4/1996 | Berger |
| 5,516,390 | A | | 5/1996 | Tomita et al. |
| 5,597,884 | A | | 1/1997 | Bender |
| 5,624,478 | A | * | 4/1997 | Patapanian et al. ..... 96/108 |
| 5,641,088 | A | | 6/1997 | Berger |
| 5,641,425 | A | | 6/1997 | McKedy et al. |
| 5,667,863 | A | | 9/1997 | Cullen et al. |
| 5,684,094 | A | | 11/1997 | Suzuki et al. |
| 5,686,161 | A | | 11/1997 | Cullen et al. |
| 5,746,937 | A | | 5/1998 | McKedy et al. |
| 5,773,105 | A | | 6/1998 | Klett |
| 5,801,220 | A | | 9/1998 | Desai et al. |
| 5,816,438 | A | | 10/1998 | Berger et al. |
| 5,824,140 | A | | 10/1998 | Berger |
| 5,833,784 | A | | 11/1998 | Berger |
| 5,839,593 | A | | 11/1998 | McKedy et al. |
| 5,879,490 | A | | 3/1999 | Berger |
| 5,889,093 | A | | 3/1999 | Hatakeyama et al. |
| 5,936,178 | A | | 8/1999 | Saari |
| 5,942,060 | A | | 8/1999 | Berger |
| 5,962,333 | A | | 10/1999 | Incorvia et al. |
| 6,004,477 | A | | 12/1999 | Nakagawa et al. |
| 6,133,361 | A | | 10/2000 | Hatakeyama et al. |
| 6,139,935 | A | | 10/2000 | Cullen et al. |
| 6,156,231 | A | | 12/2000 | McKedy |
| 6,167,720 | B1 | | 1/2001 | Chisnell |
| 6,209,289 | B1 | | 4/2001 | Cullen et al. |

(Continued)

FOREIGN PATENT DOCUMENTS

EP 0387604 A1 9/1990

(Continued)

OTHER PUBLICATIONS

Machine generated English translation of JP 10-238934 A, published Sep. 1998.*

(Continued)

*Primary Examiner* — Frank Lawrence, Jr.

(74) *Attorney, Agent, or Firm* — Stephen B. Salai, Esq.; Paul A. Leipold, Esq.; Harter Secrest & Emery LLP

(57) ABSTRACT

The invention provides a produce preserving article comprising a mixture of humectant and silica gel sorbent.

39 Claims, No Drawings

U.S. PATENT DOCUMENTS

| | | | | |
|---|---|---|---|---|
| 6,248,690 | B1 | 6/2001 | McKedy | |
| 6,318,115 | B1 | 11/2001 | Kirchner et al. | |
| 6,436,872 | B2 | 8/2002 | McKedy | |
| 6,457,294 | B1 | 10/2002 | Virnelson et al. | |
| 6,460,271 | B2 | 10/2002 | Hekal | |
| 6,465,532 | B1 | 10/2002 | Hekal et al. | |
| 6,506,233 | B2 | 1/2003 | Smith | |
| 6,540,937 | B1 | 4/2003 | Payne et al. | |
| 6,558,571 | B1 | 5/2003 | Powers | |
| 6,562,452 | B2 | 5/2003 | Ferri | |
| 6,569,532 | B2 | 5/2003 | Tomiyoshi et al. | |
| 6,571,942 | B2 | 6/2003 | Riemenschneider et al. | |
| 6,596,191 | B2 | 7/2003 | Sakamoto et al. | |
| 6,613,405 | B1 | 9/2003 | Hekal | |
| 6,649,086 | B2 | 11/2003 | Payne et al. | |
| 6,652,775 | B2 | 11/2003 | Payne et al. | |
| 6,667,273 | B1 | 12/2003 | Cullen et al. | |
| 6,688,468 | B2 | 2/2004 | Waterman | |
| 6,705,463 | B1 | 3/2004 | Bucholtz et al. | |
| 6,767,521 | B1 | 7/2004 | Vogt et al. | |
| 6,769,558 | B1 | 8/2004 | Bucholtz | |
| 6,796,423 | B2 | 9/2004 | Miller | |
| 7,501,011 | B2 * | 3/2009 | Powers et al. | 96/118 |
| 2001/0023232 | A1 | 9/2001 | McKedy | |
| 2001/0048096 | A1 | 12/2001 | Sakamoto et al. | |
| 2002/0132359 | A1 | 9/2002 | Waterman | |
| 2003/0042166 | A1 | 3/2003 | Waterman | |
| 2003/0194516 | A1 | 10/2003 | Payne et al. | |
| 2003/0203081 | A1 | 10/2003 | Saari et al. | |
| 2004/0224144 | A1 | 11/2004 | Saari et al. | |
| 2005/0072985 | A1 | 4/2005 | Yamamoto | |
| 2005/0262757 | A1 | 12/2005 | Wong et al. | |
| 2006/0078584 | A1 | 4/2006 | Lightcap et al. | |
| 2006/0097223 | A1 * | 5/2006 | Powers et al. | 252/194 |
| 2007/0175330 | A1 | 8/2007 | Barone et al. | |
| 2008/0017528 | A1 | 1/2008 | Magargee et al. | |

FOREIGN PATENT DOCUMENTS

| | | | |
|---|---|---|---|
| EP | 400460 | | 12/1990 |
| EP | 432438 | | 6/1991 |
| EP | 0864630 | B1 | 9/1998 |
| EP | 1000873 | B1 | 11/2003 |
| EP | 0892673 | B1 | 2/2004 |
| JP | 59-026475 | | 2/1984 |
| JP | 06-288672 | A * | 10/1994 |
| JP | 08-086558 | A | 4/1996 |
| JP | 10-238934 | A * | 9/1998 |
| KR | 10-0165968 | B1 | 12/1998 |
| KR | 10-2002-0035402 | A | 5/2002 |
| WO | 92/12004 | | 7/1992 |
| WO | 96/29603 | | 9/1996 |
| WO | 97/32663 | | 9/1997 |
| WO | 02/50178 | A1 | 6/2002 |
| WO | 03/013843 | A1 | 2/2003 |
| WO | 03/016037 | A1 | 2/2003 |
| WO | 03/086900 | A1 | 10/2003 |
| WO | 2004/000703 | A1 | 12/2003 |
| WO | 2004/033320 | A2 | 4/2004 |
| WO | 2004/033339 | A1 | 4/2004 |
| WO | 2004/034024 | A2 | 4/2004 |

OTHER PUBLICATIONS

Office Action dated Mar. 25, 2008 for U.S. Appl. No. 10/984,080.

PCT/US05/39999 International Search Report and Written Opinion dated Jul. 8, 2008.

Australian Examiner's Report dated Dec. 8, 2008, 2 pages.

Chaplin, Martin, Carboxymethylcellulose, Water Structure and Science, dated Oct. 17, 2008, 2 pages.

Luther, Brian, White Rot vs. Brown Rot, and how to Distinquish Them, Spore Prints, Bulletin of The Puget Sound Mycological Society, Jan. 2007, pp. 5-6.

Australian Examiner's First Report dated Oct. 5, 2007, 2 pages.

Canadian Intellectual Property Office Official Action dated Jun. 20, 2009, 4 pages.

U.S. Appl. No. 12/180,983, filed Jul. 28, 2008, Humidity Control for Produce in a Refrigerator, 13 pages.

PCT—Notification of Transmittal of the International Search Report and the Written Opinion of the International Searching Authority, or the Declaration; dated Feb. 22, 2010 (4 pages).

PCT—International Search Report; dated Feb. 22, 2010 (3pages).

PCT—Written Opinion of the International Searching Authority; dated Feb. 22, 2010 (4 pages).

KIPO, PCT International Search Report/Written Opinion, dated Feb. 10, 2011, 6 pages.

Ethylene Control, Inc., http://www.ethylenecontrol.com/about.html, May 5, 2008 pp. 1-3.

"Properties and Recommended Conditions for Marine Transport of Horticultural Commodities", 1984 Produce Marketing Almanac Supplement, pp. 37-39.

* cited by examiner

HUMIDITY CONTROL FOR PRODUCT IN A REFRIGERATOR

BACKGROUND OF THE INVENTION

In the storage of produce in a refrigerator the material is generally kept in a drawer that is specified for vegetables or fruit. The drawer, generally having a sealing strip, provides separation from the usual drying atmosphere of a frost free refrigerator. However, there are continuing problems with the keeping of fruit and vegetables in such drawers. Some vegetables and fruit give off water that will condense in the drawer and lead to rotting of the vegetables, and the growth of molds or other fungi on the fruits and vegetables, if the humidity is too high. In other instances, the drawer will develop low humidity, as in the rest of the refrigerator, and not maintain a high enough humidity to prevent fruit and vegetables from drying out.

Another difficulty with the storage of fruits and vegetables in a drawer is that many of them give off ethylene when ripening. Fruits such as bananas, apples, avocados, and pears, give off ethylene at fairly high rate. Many other vegetables also give off ethylene, at a lower rate. This ethylene can lead to rapid ripening of these fruits and others that are stored in the same produce container or drawer. This rapid ripening will actually hasten the rotting process, which any increase in moisture will spur.

There remains a need for a way of better keeping vegetables and fruits from spoiling while stored in a refrigerator, particularly in the produce drawer. It would be desired to maintain the humidity within the drawer in a desired range. It would be desirable if there was a way to control humidity in a produce drawer and also to control other undesirable things that can happen to produce in the drawer, such as rapid ripening, spoilage, and smelling.

FIELD OF THE INVENTION

The invention relates to a produce preserver that is an article for moisture control in produce storage. The invention particularly relates to the use of such a device in the produce drawer of a refrigerator.

BRIEF SUMMARY OF THE INVENTION

The objective of the invention is to overcome disadvantages of the prior art.

Another object of the invention is to improve and lengthen the produce storage time in the produce drawer of a refrigerator.

The invention provides a produce preserving article comprising a mixture of humectant, and sorbent.

In another embodiment of the invention there is provided a refrigerator comprising a produce drawer wherein the produce drawer is provided with a produce preserving article comprising a mixture of humectant, and silica gel sorbent.

DETAILED DESCRIPTION OF THE INVENTION

The invention provides longer storage of produce without deterioration. The invention provides a way for preventing condensation in the produce drawer of a refrigerator. In a further embodiment, the invention provides a reduction in ripening of vegetables and fruit by absorption of ethylene. The invention will further control humidity to a range that is satisfactory for storage of vegetables and fruit. In another embodiment, the invention absorbs odors. These and other advantages will be apparent from the detailed description below.

The produce preserving article of the invention comprises a mixture of humectant and sorbent in an effective combination in the container that will absorb excess moisture, at above about 85 or 90% humidity and release water into the air of the container when they moisture content gets below about 70 or 80%. By doing this, the article controls the moisture to an amount that is generally desirable for produce materials, that is, in a range where the humidity level in the container is insufficient to produce condensation, but is sufficient to keep the produce material turgid. Produce materials as used herein, that means, both fruit and vegetables. Included in vegetables are root materials such as turnips and parsnips.

The preserving article of the invention generally is placed in the produce drawer of a refrigerator where air seals for the drawer substantially isolate it from the general humidity in the refrigerator.

A humectant of the invention will operate with the sorbent to produce a desired humidity in a vegetable drawer. The humectant is a substance having an affinity for water, with stabilizing action on the water content of a material. A humectant keeps its surrounding environment within a narrow range the moisture content charge caused by humidity fluctuations. Suitable humectants for the invention are metal salts such as potassium chloride, sodium chloride, sodium sulfate, sodium carbonate, and mixtures thereof. A preferred material is potassium sulfate as this material is effective at the desired relative humidity and it is low in cost.

A sorbent material may be any material that will combine with and hold water in the article. This will prevent the condensation in the drawer. Any suitable sorbent may be utilized. Typical of sorbent's are silica gel and activated carbon. A preferred sorbent is wide pore silica gel as this material is able to absorb a, large amount of water without losing its porous structure. A wide pore silica may be considered as having at least 15% of the pores having a pore diameter of greater than 350 Ångstroms. In the event activated carbon is used as the sorbent material it is unable to absorb as much water as a wide pore silica gel, but it is additionally effective against odor that may develop from the produce drawer. Combinations of sorbents also can be utilized.

It is known that during ripening some types of fruit and vegetables give off ethylene. Bananas, apples and pears are known to give off ethylene in higher quantities although other fruits such as berries, avocados and pineapples also give off ethylene. This ethylene, if trapped in the produce drawer, hastens ripening of these materials as well as other vegetables and fruit. However, excessive ripening, or "over-ripening" is known to be deleterious to fruits and vegetables; such effect include the degredation of flesh of the fruit or vegetable and reducing the potency of essential vitamins and minerals, thus rendering the fruit or vegetable ill suited for consumption. Suitable ethylene absorbers are activated carbon, thiols, mercaptan, potassium permanganate, activated carbon coated with thiol or mercaptan, and calcium peroxide. These materials may be utilized in any effective amount. Carbon or activated carbon may be utilized as a carrier for these materials in order to allow better blending into the produce preserver.

As was stated earlier the compositions of the invention can absorb water or water vapor and release water or water vapor in order to maintain a relatively stable relative humidity in the produce drawer. The amount of the humidity control varies with the moisture holding capacity of the produce preserver. Potassium sulfate will maintain a relative humidity of between 90 and 95%, although when blended with wide pore silica gel, it will maintain a humidity of closer to 85%. The quantity and type of the sorbent and humectants, the transmission capabilities of the material the sorbent and humectants is packaged in, as well as the amount of water given off in a drawer, influence the kinetics of the overall absorption of desorption of moisture, and thus determine the life and effectiveness of the produce preserver.

The produce preserving article of the invention he be placed into the produce container of the refrigerator in several ways. The article may comprise a covering of a leak-proof water vapor permeable material such as Tyvek™ to form a sachet. Any other vapor permeable, but not liquid water permeable non-woven material would also be well suited for such a sachet, such as Packline™, by Polymer Group Inc. (PGI). In the alternative, the product preserving article may be an easily fastened to a board or sheet with adhesive. The produce preserving sheet or sachet, maybe fastened to the drawer to minimize the possibility of it becoming mixed with the produce. The refrigerator produce drawer may contain a vented, to the drawer, pocket that the produce preserver may be kept in and not physically mixed with the produce.

The article of the invention for may contain other active ingredients. The other active ingredients may include biostats or fungicides. Further, the article may include scents, such as, clove oil, oregano oil, menthol, or lime. The article may contain a deodorizer such as activated carbon.

The ingredients of the produce preserving article may be mixed in any effective amount. Generally the sorbent and humectant may be in amounts of 4-10 parts by weight sorbent and between 0.5 and 1.5 parts by weight humectant.

The article of the invention could also be utilized in packaging of produce for shipment or sale, rather then placed in the drawer of a refrigerator. The packaging of produce requires the same need for maintenance of humidity, without having excess water vapor in the package.

In a produce preserving article that was intended for use with produce wrapped with an oxygen barrier material, the material could also contain an oxygen absorbent. This would prevent decay of the produce. At the same time, the humidity would be maintained for the produce such that it would keep for a long time in the package. Addition of an oxygen absorber for use in a produce drawer would not be very effective as it would be quickly used up as the drawer was opened and closed admitting oxygen. Oxygen absorbing materials such as ferrous iron, or ferrious iron with a suitable electrolyte could be used. Oxygen scavenging could be with the UV activated in antioxidants, such as anthraquinone-based oxygen scavenging compositions that can be efficiently activated by exposure to the UV light wavelengths below 380 nm, preferably in the presence of secondary hydropyl functionalities in the matrix polymer without any transitional metal based catalyst. Oxygen scavenger materials such as in U.S. Pat. No. 5,350,622 (Speer et al.) and U.S. Pat. No. 6,569,506 also would be suitable.

EXAMPLE

Objective: Regulate condensation inside vegetable bin.

Method:

Master batch:

1. Dissolved 285 grams of potassium sulfate ($K_2SO_4$) into 2855 ml distilled water, heated to 44° C., to form a solution.
2. Add 753.52 grams of wide pore silica gel (WPSG) to Kitchen Aid mixer; dispense 502.48 ml of $K_2SO_4$ solution of step 1 into gel very slowly.
3. Scrape down sides and mix an additional 2 minutes.
4. Add 56 grams of dry $K_2SO_4$ to blend, mix 5 minutes, remove from bowl and seal in barrier pouch. This is at the saturation point of $K_2SO_4$ and the blend stays supersaturated when cooled.
5. 15 grams of mixture 4 are placed in a Tyvek™ or Packline™ sachet, formed either on a vertical or horizontal "form-fill-seal" machine.
6. The sachet will maintain a relative humidity below 90% in a produce drawer for 5 days with 6 ripe apples weighing 1.4 pounds.

The foregoing embodiments of the invention are representative embodiments, and are provided for illustrative purposes. The embodiments are not intended to limit the scope of the invention. Variations and modifications are apparent from a reading of the preceding description and are included within the scope of the invention. The invention is intended to be limited only by the scope of the accompanying claims.

The invention claimed is:

1. A produce preserving article comprising a mixture of humectant, silica gel sorbent, and an ethylene absorber comprising potassium permanganate.

2. The produce preserving article of claim 1 wherein said humectant comprises an alkali metal salt.

3. The produce preserving article of claim 2, wherein said metal salt comprises at least one member selected from the group of potassium chloride, sodium chloride, sodium sulfate, sodium carbonate, and mixtures thereof.

4. The produce preserving article of claim 1 wherein said humectant comprises potassium sulfate.

5. The produce preserving article of claim 1 wherein said article is further provided with an oxygen absorber.

6. The produce preserving article of claim 1 wherein said silica gel, comprises a wide pore silica gel.

7. The produce preserving article of claim 1 herein said preserving article comprises activated carbon.

8. The produce preserving article of claim 1 wherein said sorbent is present in an amount of between 4 and 10 parts by weight and the humectant is present in an amount of between 0.5 and 1.5 parts by weight.

9. The produce preserving article of claim 1 wherein the mixture is contained in a moisture vapor permeable sachet.

10. A refrigerator comprising a produce drawer wherein the produce drawer is provided with a produce preserving article comprising a mixture of humectant, sorbent, and an ethylene absorber comprising calcium peroxide.

11. The refrigerator of claim 10 wherein said humectant comprises an alkali metal salt.

12. The refrigerator of claim 11, wherein the alkali metal salt comprises at least one member selected from the group of potassium chloride, sodium chloride, sodium sulfate, sodium carbonate, and mixtures thereof.

13. The refrigerator of claim 10 wherein said humectant comprises potassium sulfate.

14. The refrigerator of claim 10 wherein said sorbent comprises silica gel.

15. The refrigerator of claim 14 wherein said silica gel, comprises a wide pore silica gel.

16. The refrigerator of claim 10 herein said sorbent comprises activated carbon.

17. The refrigerator of claim 10 wherein said sorbent is present in an amount of between 4 and 10 parts by weight and sorbent and the humectant is present in an amount of between 0.5 and 1.5 parts by weight.

18. The refrigerator of claim 10 wherein the mixture is contained in a moisture permeable sachet.

19. The refrigerator of claim 10 wherein the drawer is provided with a seal.

20. The refrigerator of claim 10 wherein there is air circulation in the drawer.

21. The refrigerator of claim 10 wherein the produce drawer has a vented to the drawer pocket or a place to put the produce preserving article.

22. A produce preserving article comprising a mixture of humectant, silica gel sorbent, and an ethylene absorber comprising activated carbon coated with a mercaptan or a thiol.

23. The produce preserving article of claim 22 wherein said humectant comprises an alkali metal salt.

24. The produce preserving article of claim 23, wherein said metal salt comprises at least one member selected from the group of potassium chloride, sodium chloride, sodium sulfate, sodium carbonate, and mixtures thereof.

25. The produce preserving article of claim 22 wherein said humectant comprises potassium sulfate.

26. The produce preserving article of claim 22 wherein said article is further provided with an oxygen absorber.

27. The produce preserving article of claim 22 wherein said sorbent is present in an amount of between 4 and 10 parts by weight and the humectant is present in an amount of between 0.5 and 1.5 parts by weight.

28. The produce preserving article of claim 22 wherein the mixture is contained in a moisture vapor permeable sachet.

29. A refrigerator comprising a produce drawer wherein the produce drawer is provided with a produce preserving article comprising a mixture of humectant, sorbent, and an ethylene absorber comprising activated carbon coated with a mercaptan or a thiol.

30. The refrigerator of claim 29 wherein said humectant comprises an alkali metal salt.

31. The refrigerator of claim 30, wherein the alkali metal salt comprises at least one member selected from the group of potassium chloride, sodium chloride, sodium sulfate, sodium carbonate, and mixtures thereof.

32. The refrigerator of claim 29 wherein said humectant comprises potassium sulfate.

33. The refrigerator of claim 29 wherein said sorbent comprises silica gel.

34. The refrigerator of claim 33 wherein said silica gel, comprises a wide pore silica gel.

35. The refrigerator of claim 29 wherein said sorbent is present in an amount of between 4 and 10 parts by weight and sorbent and the humectant is present in an amount of between 0.5 and 1.5 parts by weight.

36. The refrigerator of claim 29 wherein the mixture is contained in a moisture permeable sachet.

37. The refrigerator of claim 29 wherein the drawer is provided with a seal.

38. The refrigerator of claim 29 wherein there is air circulation in the drawer.

39. The refrigerator of claim 29 wherein the produce drawer has a vented to the drawer pocket or a place to put the produce preserving article.

* * * * *